US007320626B2

(12) United States Patent
Drane et al.

(10) Patent No.: US 7,320,626 B2
(45) Date of Patent: Jan. 22, 2008

(54) TRANSFORMER STUD CONNECTOR WITH IMPROVED CONDUCTIVITY USING A SPECIAL THREAD PROFILE

(75) Inventors: Mark R. Drane, Germantown, TN (US); George Triantopoulos, Collierville, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 11/168,016

(22) Filed: Jun. 27, 2005

(65) Prior Publication Data

US 2005/0287876 A1 Dec. 29, 2005

Related U.S. Application Data

(60) Provisional application No. 60/583,869, filed on Jun. 29, 2004.

(51) Int. Cl.
*H01R 11/09* (2006.01)

(52) U.S. Cl. ..... 439/798

(58) Field of Classification Search ..... 439/798, 439/521, 814; 411/308, 309, 310
See application file for complete search history.

(56) References Cited

U.S. PATENT DOCUMENTS

| | | | | |
|---|---|---|---|---|
| D309,664 | S | 7/1990 | McGrane | |
| D346,150 | S | 4/1994 | Triantopoulos | |
| D377,782 | S | 2/1997 | Fillinger | |
| 5,624,219 | A * | 4/1997 | Hamanaka | 411/308 |
| 5,690,516 | A * | 11/1997 | Fillinger | 439/798 |
| 5,848,913 | A * | 12/1998 | Ashcraft | 439/521 |
| 5,876,168 | A * | 3/1999 | Iwata | 411/308 |
| 5,931,708 | A * | 8/1999 | Annas et al. | 439/798 |
| 5,944,465 | A * | 8/1999 | Janitzki | 411/310 |
| 6,579,131 | B1 * | 6/2003 | Ashcraft et al. | 439/798 |
| 6,939,183 | B2 * | 9/2005 | Ferretti et al. | 439/798 |
| 2002/0094729 | A1 * | 7/2002 | Triantopoulos et al. | 439/798 |
| 2005/0233648 | A1 | 10/2005 | Siracki et al. | |
| 2005/0233649 | A1 | 10/2005 | Siracki et al. | |

FOREIGN PATENT DOCUMENTS

| | | |
|---|---|---|
| DE | 38 04 291 | 8/1989 |

* cited by examiner

*Primary Examiner*—Tulsidas C. Patel
*Assistant Examiner*—Vladimir Imas
(74) *Attorney, Agent, or Firm*—Hoffmann & Baron, LLP

(57) ABSTRACT

A connector for attachment to an extending transformer stud. The connector includes an elongate central body having a central aperture and an opening at one end for insertable accommodation of the transformer stud. The central aperture accepts a single or more than one size stud without increasing the size and cost needed for two separate mounting holes. The connector according to the present invention accepts the pitch of at least two different size threads and with the typical setscrew locking arrangement, maintains thread engagement on one side of the stud, thus securing the stud. The connector according to the present invention further provides a connector threadform having a reduced threadform angle than the stud threadform to provide greater conductivity and reduced electrical resistance between the stud and connector at lower set screw torque settings.

5 Claims, 7 Drawing Sheets

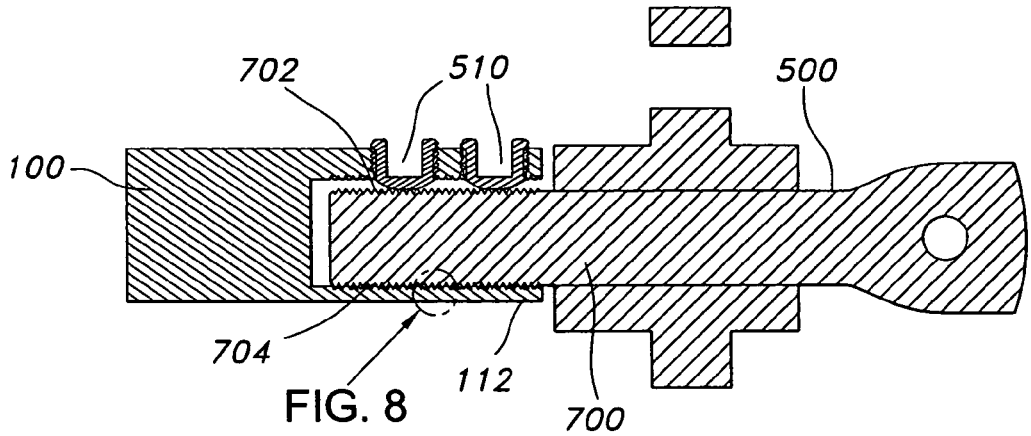
FIG. 8
FIG. 7
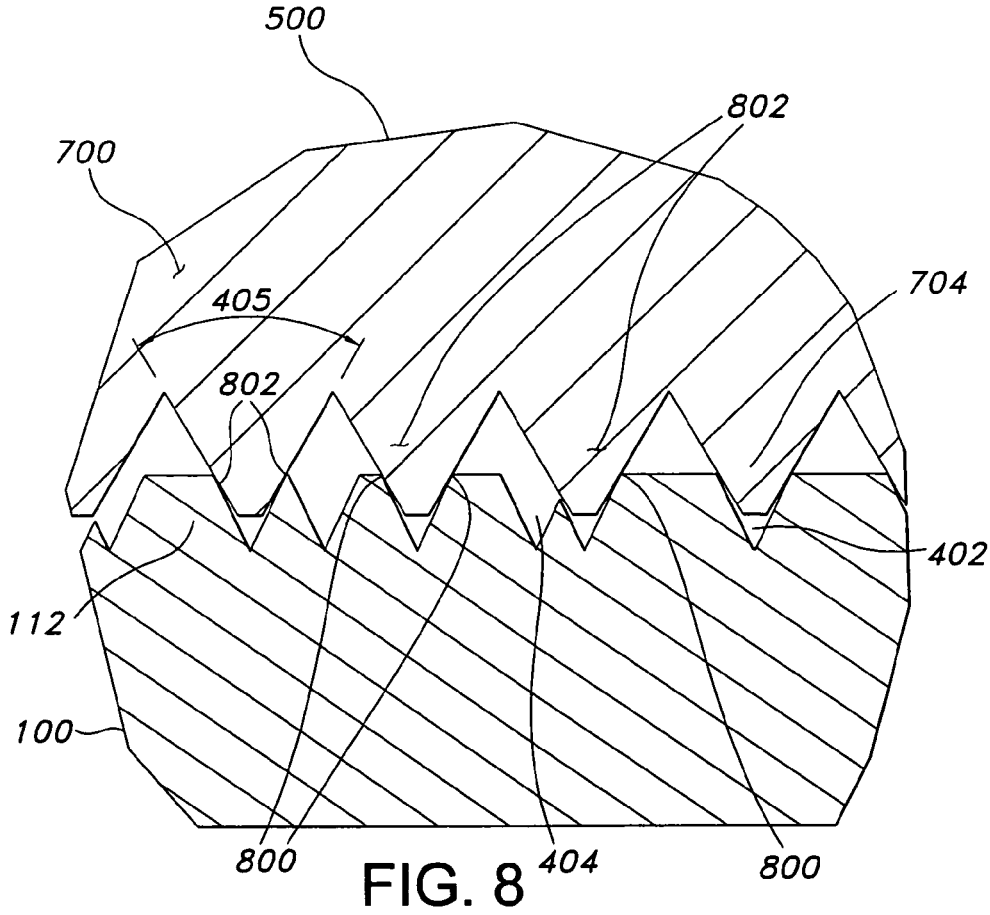
FIG. 8

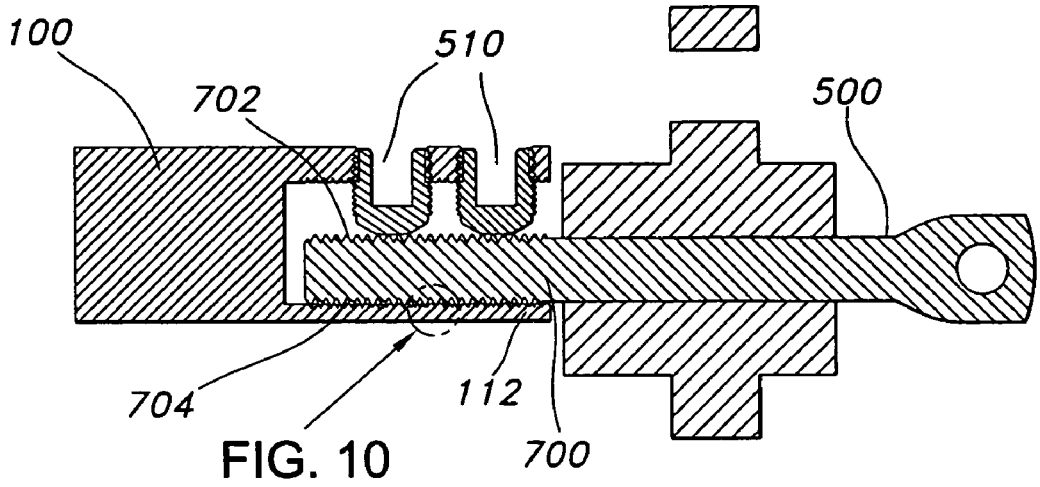
FIG. 10
FIG. 9
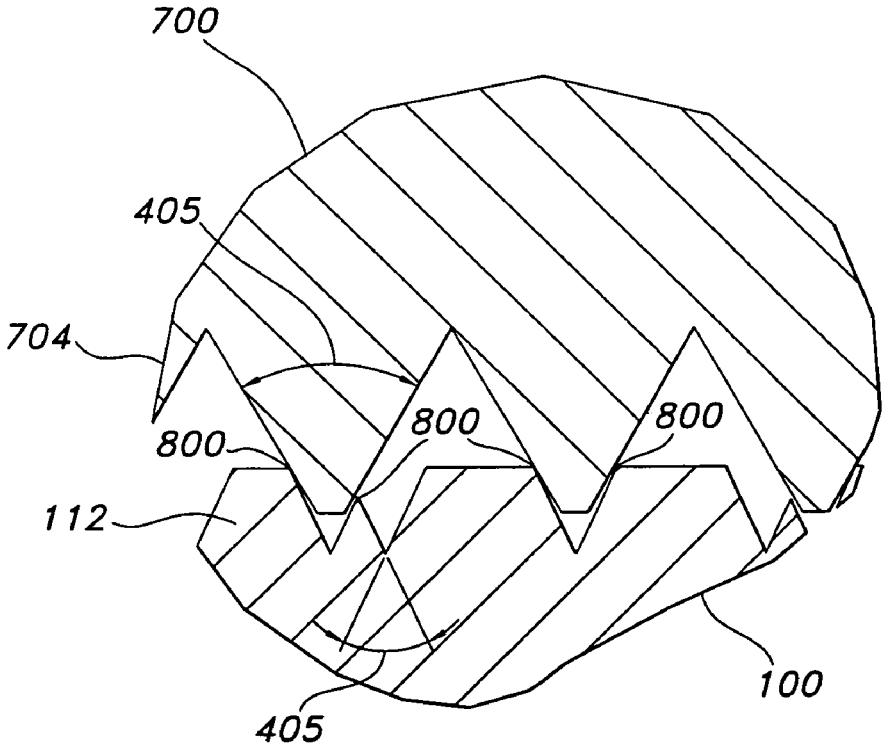
FIG. 10

TRANSFORMER STUD CONNECTOR WITH IMPROVED CONDUCTIVITY USING A SPECIAL THREAD PROFILE

CROSS-REFERENCE TO RELATED APPLICATION

This application claims priority to U.S. Provisional Application No. 60/583,869, filed Jun. 29, 2004, which are incorporated herein by reference.

FIELD OF THE INVENTION

The present invention relates generally to a connector for connecting to a transformer having and more particularly, to a transformer stud connector, having a unique thread profile, which permits the connector to be installed on the transformer stud with lower torque on set screws.

BACKGROUND OF THE INVENTION

Electrical transformers are typically used to distribute electrical power from main utility lines for secondary distribution. The transformer accepts the main utility line on the primary side of the transformer and distributes the power from a secondary side of the transformer. An electrical step-down is provided by the transformer so as to provide for the proper secondary distribution of electrical power for residential and commercial use.

The transformer is normally housed in a steel cabinet. A threaded copper stud extends from the secondary side of the transformer from which secondary distribution is provided. Plural electrical conductors, connected to the threaded stud, provide for distribution of power to the end user.

In order to connect the conductor to the stud, a transformer stud connector is employed. These transformer stud connectors are elongate, electrically conductive members which are inserted over the copper stud extending from the secondary side of the transformer. The stud connector may be threadingly attached to the transformer stud. Extending longitudinally therefrom are a plurality of conductor accommodating ports wherein the ends of conductors may be inserted. Each conductor port has an associated set screw to effect mechanical and electrical connection to the transformer stud connector. Examples of transformer stud connectors are shown in U.S. Pat. Nos. 5,931,708; 5,848,913; 5,690,516; DES 377,782; DES 346,150; and DES 309,664.

In a typical arrangement, the utility distribution transformer has threaded studs typically ⅝-11 or 1-14. A connector, sometimes referred to as a bus bar, is used to connect to the stud and provide ports for multiple wire connections. The connector is threaded with the same pitch thread but the threaded hole is equal or larger to the diameter of the transformer stud. The larger threaded hole allows the connector to be slipped on to the stud, known as a slip fit connector, instead of being spun onto the treaded shaft. This allows the connector to be installed and removed without having to remove any of the conductors. An orthogonally mounted setscrew is typically used to secure the connector to the studded shaft.

In prior art connectors, various means were provided so that a single connector could be used to service studs of various sizes. One way is to provide at least two threaded holes, one for each of the stud sizes serviced by the connector. However, the disadvantage of such design is that it requires at least two holes, and therefore needs to be larger than necessary. Also, because by design the stud hole has to meet a certain depth to accommodate the stud, the portion of the connector receiving the threaded stud is not usable for conductor connections, thus additionally requiring a longer connector to accommodate an equal number of conductors. This problem is exacerbated for connectors having multiple threaded holes.

A further prior art design utilizes a tear-drop design of two holes which both intersect and overlap and therefore produce a large diameter hole which may or may not be threaded. It has an arc-section of a smaller hole at the bottom of the larger hole, which extends beyond the perimeter of the larger hole. This design is commonly known as the "tear-drop" design. The disadvantage of this design is that it requires pre-drilling a smaller hole, followed by drilling of the second larger hole, partially overlapping the smaller hole. Alternately, the larger hole can be bored first, followed by milling or broaching of the bottom arc section to create the "tear-drop". Both methods therefore require a two-step process, which adds complexity and expense to the manufacturing process.

A third alternative prior art design utilizes a slider system mounted to the connector which has grooved sides at various levels on the connector body. By moving the slider in the grooves, various gap sizes between the slider and the connector body can be formed. However, this design requires a second element, the slider, to be added to the connector, which adds complexity and expense to the manufacturing process.

It is therefore desirable to provide a transformer stud connector, which can be mounted on studs of various sizes without the complexity, or cost of prior art designs and which has a more compact design and which provides for improved conductivity between the stud and connector without excessive torque being used to secure the connector.

SUMMARY OF THE INVENTION

The present invention provides a connector, which can be attached to transformer studs of various sizes with a single threaded hole.

The present invention therefore provides a connector for attachment to an extending transformer stud. The connector includes an elongate central body having a central aperture and an opening at one end for insertable accommodation of the transformer stud. The central aperture can be designed to accept more than one size stud without increasing the size and cost needed for two separate mounting holes. The connector according to the present invention can also be designed to accept the pitch of one or more than one different size thread. It may also incorporate the typical setscrew locking arrangement that maintains thread engagement on one side of the stud, thus securing the stud. The connector according to the present invention further provides a threadform having a reduced threadform angle to provide greater conductivity and reduced electrical resistance between the stud and connector at a lower set screw torque setting than a standard thread.

It is well known in the art to create threads for fastening and other applications typically by tapping or machining the proper size thread (male or female) according to the various thread standards/classes applicable. The threads are typically uniform in shape/profile throughout the threaded length of the part bearing threads. The threads are made to work with same size and type threads of a complementary part.

The present invention uses a single hole, passageway or bore within the body of a connector to accept one or more threaded studs of a transformer. Furthermore, in one embodiment the connector utilizes a distinct special threadform having an angular slope that is different and preferably reduced with respect to the standard connector stud threads. This different angular slope thread produces a two-point contact on each thread along its arc, thereby ensuring greater conductivity and reduced electrical resistance in the region of interconnection. In an alternate embodiment, the connector of the present invention utilizes an internal thread wherein the pitch dimension of each thread is larger than the thread valleys of the same internal thread.

The present invention therefore provides an electrically conductive transformer stud connector comprising a body with a longitudinal cylindrical bore or the like, wherein the connector thread has a threadform angle that is less than a threadform angle of the stud thread, the longitudinal cylindrical bore is in communication with at least one set screw port and having a set screw threadably received therein for exerting a clamping force upon the transformer stud, and at least one conductor port for receiving a conductor, each conductor port being in communication with a set screw port and having a set screw threadadly received therein for exerting a clamping force upon the conductor.

As shown by way of a preferred embodiment herein, the connector of the present invention includes an overlapped thread configuration placed along the threadform. Each thread accommodates a stud of different thread pitch and are overlapped tangently.

BRIEF DESCRIPTION OF DRAWINGS

FIG. 7 is a cross-sectional drawing of a connector and transformer stud according to the present invention at section 7-7 of FIG. 6.

FIG. 8 is a detail area of the cross-sectional drawing of FIG. 7.

FIG. 9 is an alternate cross-sectional drawing of a connector and transformer stud according to the present invention at section 7-7 of FIG. 6.

FIG. 10 is a detail area of the cross-sectional drawing of FIG. 9.

DETAILED DESCRIPTION OF THE PREFERRED EMBODIMENT

Figure 1:
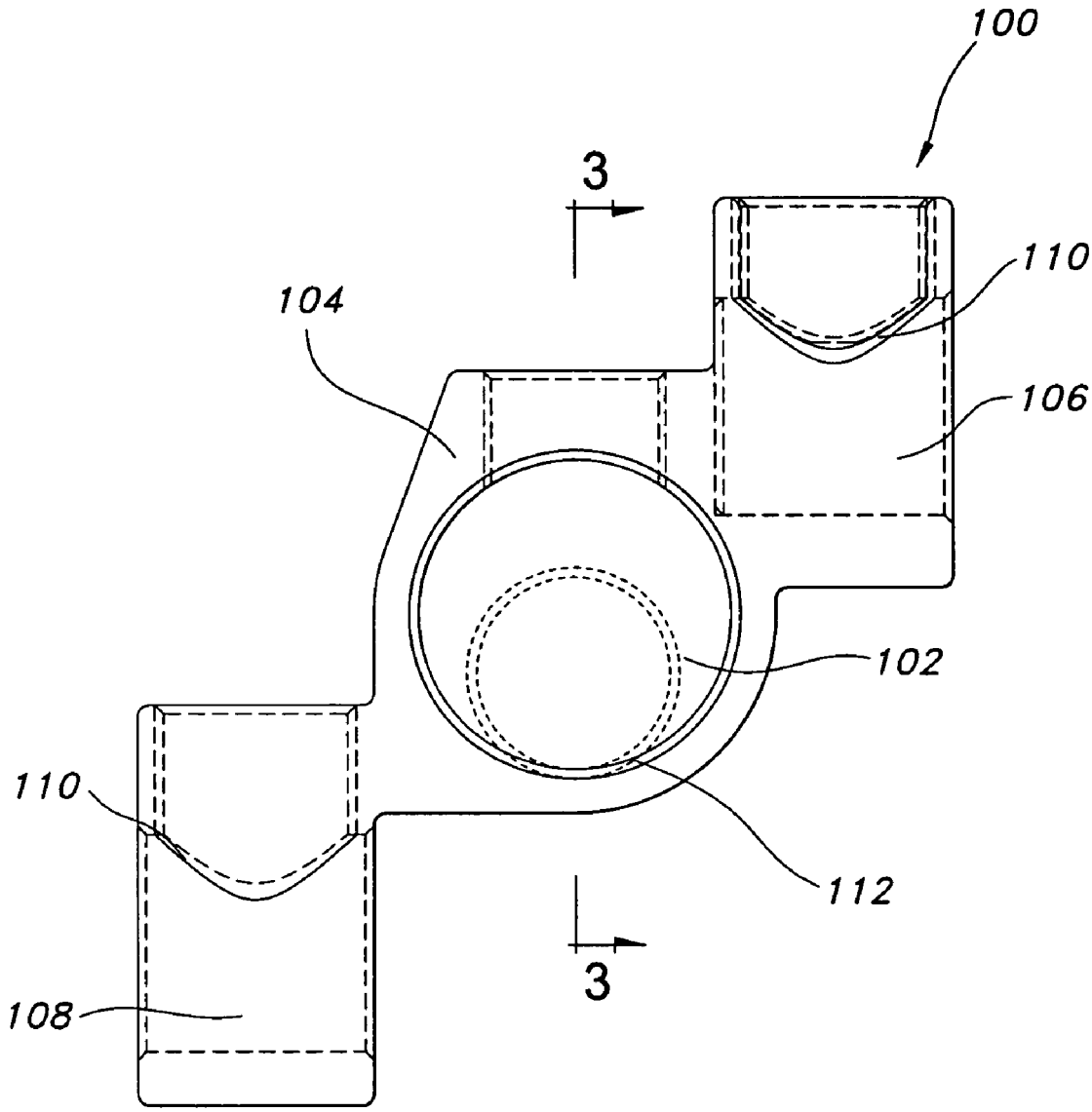
FIG. 1 shows an end view of a transformer stud connector showing two threads tapped into the end and with section lines 3-3 indicated thereon.

Referring to FIG. 1, there is shown an end view of the transformer stud connector 100 according to the present invention having a central aperture 102 tapped into the end for receiving a transformer stud. The end view of this embodiment shows the connector 100 having a central body, 104 an upper body 106 and a an lower body 108. The upper and lower bodies have conductor ports, (not seen is this view) projecting laterally from the sides and threaded set screw apertures 110 aligned along the top of each body 106, 108 for receiving a set screw for affixing the conductors to the connector 100. As will be further described hereinafter, the central aperture 102 shown in this embodiment is tapped with threads 112 for receiving a transformer stud. The connector 100 is an integrally formed metallic member, preferably formed of aluminum or other material, having high electrical conductivity. Transformer stud central aperture 102 is a generally elongate cylindrical bore or passageway which is at least partially internally threaded 112 to accommodate the extending, externally threaded transformer stud (not shown). The length of the bore need only be approximately the length of the extending portion of the stud so that when the connector 100 is placed over the stud, the stud and the bore extend generally the same distance. Preferably, the central aperture 102 is comprised of a small diameter threaded region and a large diameter threaded region although it is conceivable to have more or less than two such threaded regions. The radius of curvature of the small diameter threaded region and the large diameter threaded region are offset within the central aperture 102 by a linear distance, which is variable depending on the radius of each region.

In a preferred embodiment of the present invention, the connector 100 is produced by forming the central aperture 102 by drilling into the connector 100 to create a void. Thereafter, a first tap operation is performed to form the small diameter threaded region, which in the preferred embodiment may be a ⅝-11 thread. Once the small diameter threaded region is formed, a second tap operation is performed to form the large diameter threaded region, which in the preferred embodiment may be 1⅛-14 thread. The threaded regions are positioned within the connector 100 by offsetting the radius of curvature of the threads to be machined creating a tangency point or line of tangency of the two threaded regions directly opposite the setscrew, and also providing a single line of tangency, in a three dimensional frame of reference, along the two thread pitches. Removal of the overlapping thread sections could be done by a milling/threading/tapping operation on the side of central aperture 102 where interlocking of the transformer stud is desired, typically opposite the setscrew. Alternately, the overlapping thread sections can be formed at other locations around the entire inner diameter of central aperture 102.

In the preferred embodiment, specially cut taps can be utilized to produce a variety of thread types supplying the proper thread profile for contact surface maximization.

While the preferred embodiment of the connector 100 according to the present invention is described with respect to a particular large and small thread pitch. It would be clear to one skilled in the art that any standard or non-standard thread pitches could be overlapped in the manner described. Likewise, the present invention need not be limited to overlapping two particular thread pitches, but may include a single thread pitch or more than two particular thread pitches that are formed within central aperture 102.

Figure 2:
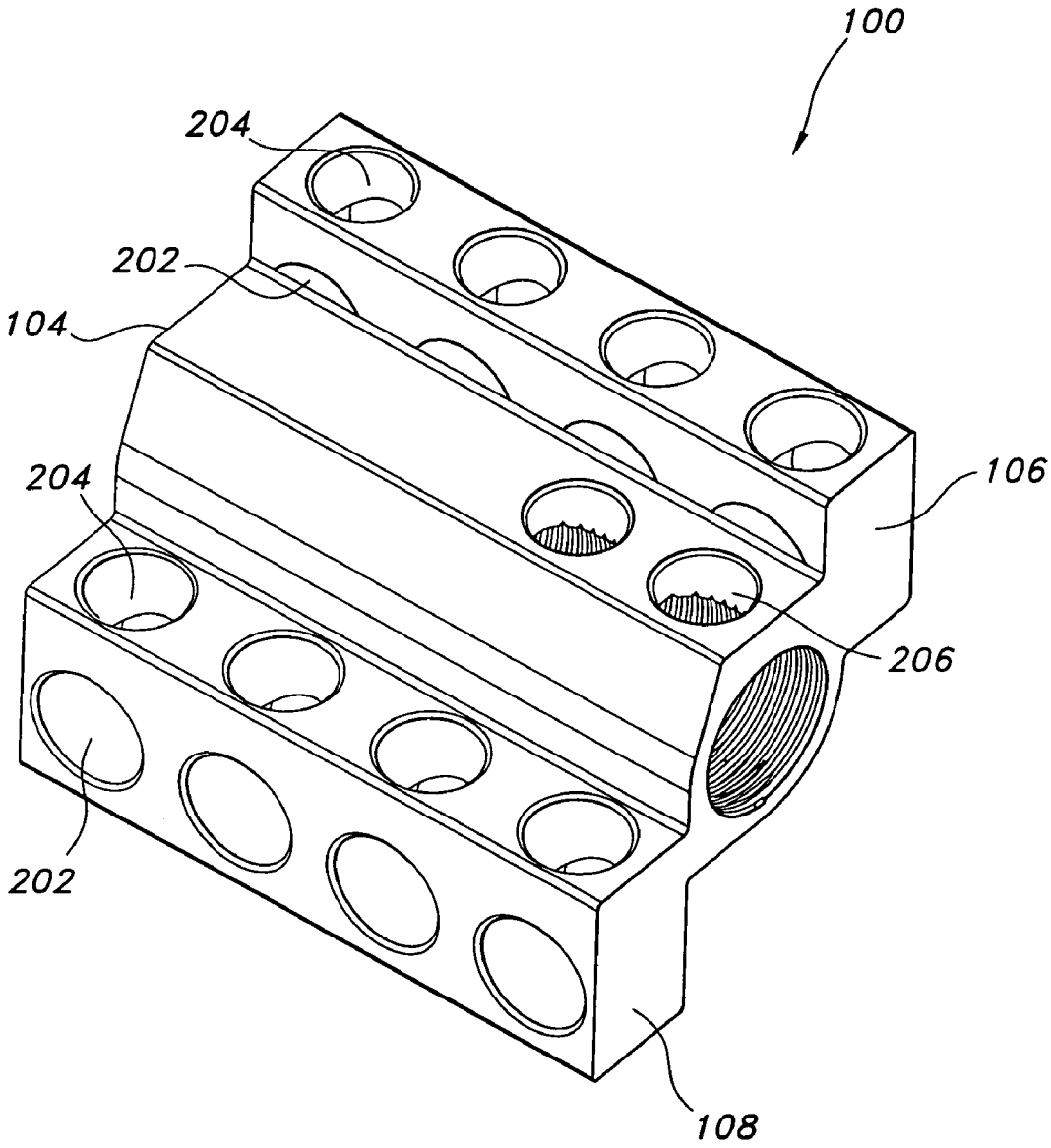
FIG. 2 shows a perspective view of a transformer stud connector according to the present invention.

Turning now to FIG. 2, there is shown a perspective view of a connector 100 according to the present invention showing conductor ports 202 for receiving conductors on lower body 108, with threaded set screw apertures 204 aligned along the top of upper body 106 and lower body 108. Furthermore, the rear of conductor ports 202 are partially visible along the rear face of upper body 106. Central body 104 has aligned along its top face threaded set screw apertures 206 for receiving set screws for securing the transformer stud (not shown) within the connector 100. Each conductor port 202 will also include a securement device such as a setscrew for securing the conductor. Each setscrew aperture 204 is in communication with the respective conductor port 202 so that setscrews (not shown) may be inserted therein to mechanically and electrically secure the ends of the conductors within the stud connector 100. In a typical arrangement, each of the set screw apertures 204 extend from one side surface of the connector 100. The conductor ports 202 are generally positioned on similarly facing surfaces of their respective body 106, 108 so that conductors inserted into each of their respective ports 202 can be inserted from the same direction.

Figure 3:
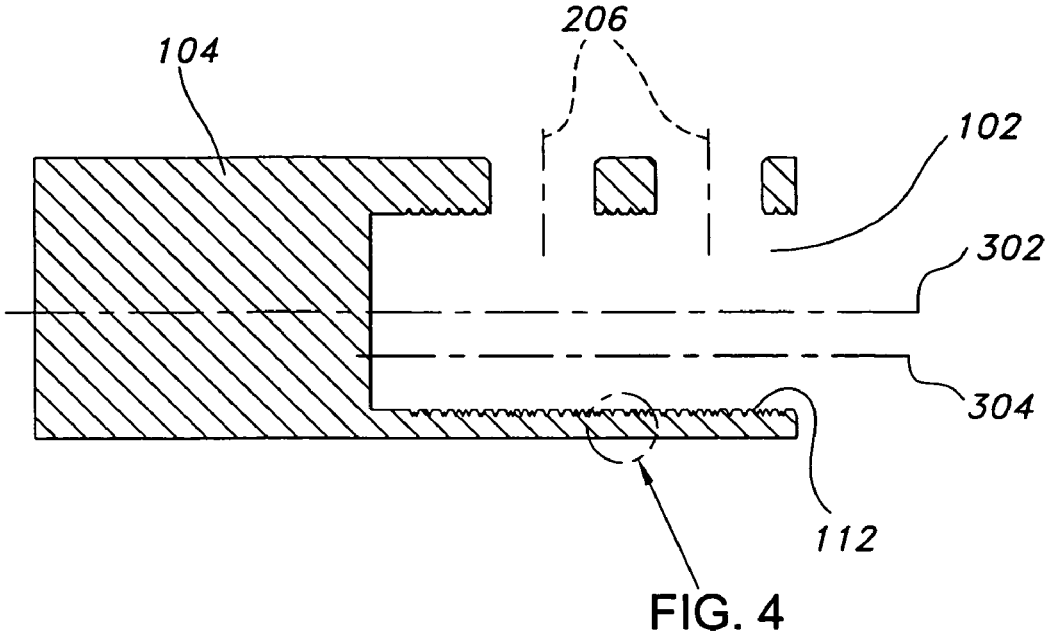
FIG. 3 is a cross-sectional drawing of a connector according to the present invention at section 3-3 of FIG. 1.

Turning now to FIG. 3, there is shown a cross sectional view of the connector 100 of FIG. 1 along section line 3-3 which coincides with the line of tangency between the two threaded regions tapped into connector 100. Depicted is the sectional view of the connector 100 according to the present invention. Depicted is a cross section of the central body 104 showing the central aperture 102. The central aperture, 102 is tapped with different size threads. In the connector depicted, the central aperture 102 is tapped to receive a 1-⅛" connector stud and a ⅝" connector stud. The center of the 1-⅛" tapped hole 302 and the ⅝" tapped hole 304 are offset within the single central aperture 102, such that the threads 112 of each tapped hole lie tangent to each other along the inner diameter of aperture 102. Further shown in FIG. 3 are cross sectional views of set screw apertures 206, which would typically be threaded.

Figure 4:
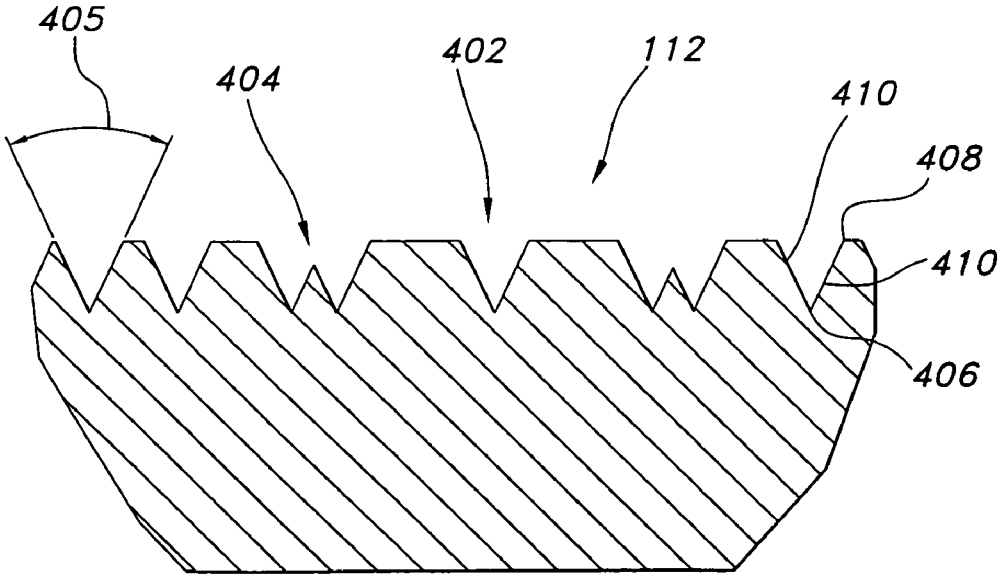
FIG. 4 is detail area of the cross-sectional drawing of FIG. 3.

Turning now to FIG. 4, there is shown a detail view of the cross sectional view of threads 112 shown in FIG. 3. The detail view shows threads 112 arranged along the line of tangency between the two threaded regions of the central aperture 102. The figure depicts threads tapped to receive 1⅛" connector stud threads 402 and ⅝" connector stud threads 404. The figure shows the root 406 and crest 408 of each thread which define the thread height. The thread roots of the first and second connector threads are aligned and the thread crests of the first and second connector threads are non-aligned. Connecting the root 406 to the crest 408 are the flanks 410 which establish the threadform angle of the internal threads 112. The flanks 410 diverge from the root 406 at an angle to form the walls of the threadform. The angle that the flanks diverge from the root to the crest is determined by the size of the stud to be used with the connector within a particular tolerance class. In other words, for a particular size stud thread 402, 404 a corresponding size threadform is utilized to match the stud threads 402, 404. The stud thread and connector threadform correspond in size within a particular tolerance class. For the connector 100 according to the present invention the threadform has two thread sizes overlayed tangently within the connector central aperture. In the connector according to the present invention, the ⅝" threadform have a threadform angle 405 by which the flanks diverge which is smaller than a standard threadform angle for a similarly sized stud thread. Specifically, while the threadform angle 405 for a standard threadform of a ⅝" thread would typically be 60°+/−½°, according to the present invention, the threadform described herein for connector 100 contains threads with a smaller threadform angle 405 not exceeding 59½°. Likewise, the threads corresponding to the 1"-stud typically have an threadform angle 405 of 60°+/−½°, while the threads of the connector 100 of the present invention have an threadform angle 405 of less than 59½°.

Figure 5:
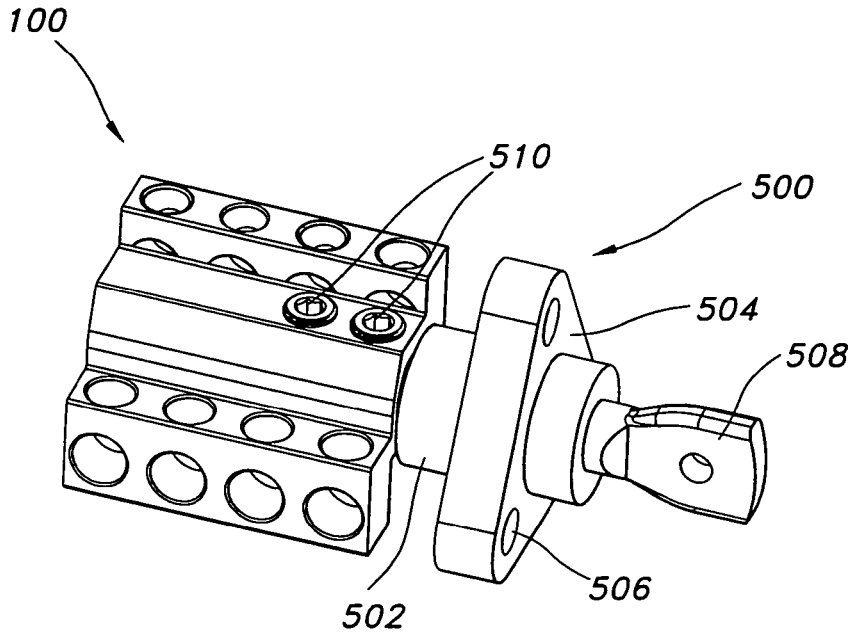
FIG. 5 is a perspective view of the transformer stud connector having a stud inserted therewith.

Turning now to FIG. 5, there is shown a perspective view of the connector 100 according to the present invention, wherein the connector is threaded onto a stud 500. The stud 500 has a threaded portion, not visible in this view, a collar 502 which abuts the connector 100 and a flange 504, having apertures 506 for receiving fasteners, such as bolts for attaching the stud to a transformer. There is also shown a spade lug 508 for providing an electrical connection between the transformer and stud 500. In the view depicted stud set screws 510 are shown threaded into the top of the connector central body 104. The stud set screws 510 is received into the connector body in a threaded bore 206 and can thus be raised or lowered by rotating the setscrew. In this way, the setscrew can be adjusted to contact a threaded stud 500 within central aperture 102. The stud set screws 510 exert a clamping force on the stud 500 in order to mechanically secure it in place within connector 100 as well as ensure optimum conductivity. Typically the set screws 510 are torqued to a value of approximately 240 inch pounds to achieve sufficient clamping. The exterior of the stud 500 depicted in FIG. 5 is representative of the different size studs, 1", and ⅝", described herein. Regarding the portion not visible, the stud 500 will differ in size from each other and will be further described hereinafter.

Figure 6:
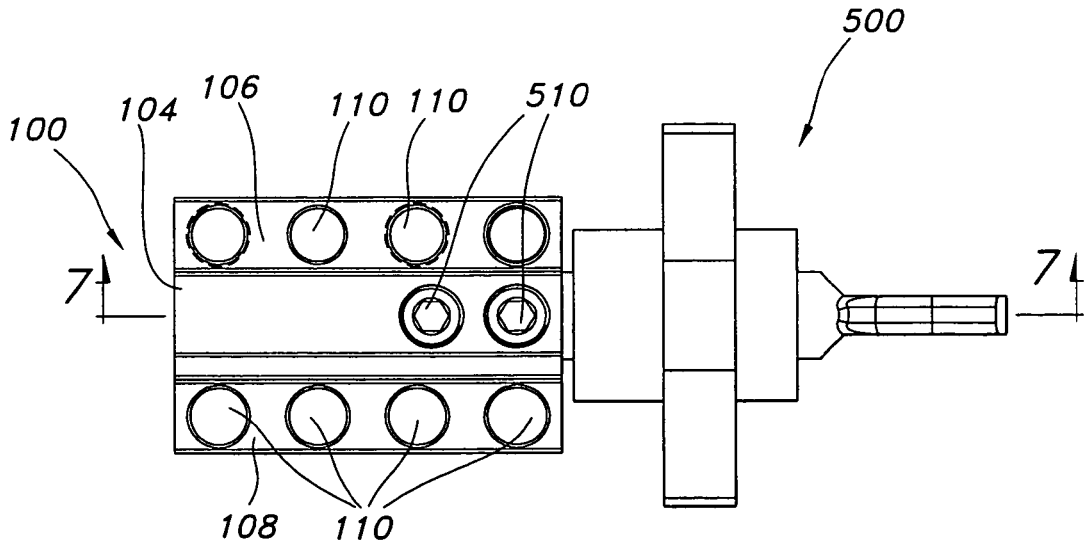
FIG. 6 is a top view of the transformer stud connector according to the present invention with section lines 7-7.

Turning now to FIG. 6 there is shown a top view depicted of the connector 100 of the present invention assembled to a transformer stud 500. The view depicts the top of the connector central body 104 and upper body 106 and lower body 108. Also visible are stud set screws 510 as well as threaded set screw apertures 110 aligned along the top of each body 106, 108 for receiving a set screw for affixing the conductors to the connector 100.

Turning now to FIG. 7 there is shown a cross sectional view of the stud connector 100 according to the present invention along cross section 7-7 shown in FIG. 6. In this view there is shown a transformer stud 500 installed within central aperture 102, the stud 500 having a diameter slightly smaller than central aperture 102, such that the connector 100 can be slipped over stud 500 without the stud 500 and connector 100 threads becoming engaged. Once the stud 500 is fully inserted within the connector 100, setscrews 510 are rotated to bear against stud 500, thereby causing the threaded portion 700 of stud 500 to engage the complementary pitch threads along their arc within central aperture 102 and thus secure the connector 100 to the stud 500. More specifically, FIG. 7 shows the threaded portion 700 of stud 500, assembled with connector 100. In this exemplary depiction, there is shown a 1" diameter stud 500 assembled with connector 100. Stud set screws 510 are shown in a tightened position, in which the set screws 510 bear against the top 702 of the threaded portion 700 of stud 500. The bottom 704 of the threaded portion 700 bears against a threaded region or arc of the various threads 112 of connector 100 due to the normal force exerted upon the threaded portion 700 of stud 500. As will be further shown and described with respect to FIG. 8, the threaded portion 700 contacts the threads 112 of connector 100 in such a was so as to provide two point contact between the various threads along an arc for greater conductivity and reduced electrical resistance.

Turning now to FIG. 8 there is shown an expanded view shown in FIG. 7. FIG. 8 shows the bottom 704 of the threaded portion 700 of stud 500 in cooperative engagement with threads 112 of connector 100. The bottom 704 of the threaded portion 700 of the stud have a standard threadform angle 405. In the exemplary depicted a 1" diameter stud is shown having a threadform angle 405 of 60.0°+/−½°. The threads 112 of connector 100 have a smaller threadform angle along their arc than the standard threadform for the 1" stud depicted, in this exemplary depiction approximately 59 ½° or less. By narrowing the threadform angle of connector 100 in accordance with the present invention, the threads 112 of connector 100 contact the stud 500 on two locations 800 at each stud thread crest 802 along an arc. In that way, greater conductivity and reduced electrical resistance can be achieved at lower set screw torque setting than a standard thread connector.

Turning now to FIG. 9 there is shown a cross sectional view of the stud connector 100 according to the present invention along cross section 7-7 shown in FIG. 6. FIG. 9 shows the threaded portion 700 of stud 500 assembled with connector 100. In this exemplary depiction, there is shown a ⅝" diameter stud 500 assembled with connector 100. Stud set screws 510 are shown in a tightened position, in which the set screws 510 bear against the top 702 of the threaded portion 700 of stud 500. The bottom 704 of the threaded portion 700 bears against the threads 112 of connector 100 along an arc due to the normal force exerted upon the threaded portion 700 of stud 500. As will be further shown and described with respect to FIG. 10, the threads of threaded portion 700 contact threads 112 of connector 100 in such a was so as to provide two point contact between the threads along an arc for greater conductivity and reduced electrical resistance.

Turning now to FIG. 10 there is shown an expanded view shown in FIG. 9. FIG. 10 shows the bottom 704 of the threaded portion 700 of stud 500 in cooperative engagement with threads 112 of connector 100. The bottom 704 of the threaded portion 700 of the stud have a standard threadform angle 405. In the exemplary depiction a ⅝" diameter stud is shown, having a threadform angle of 60.0°+/−½°. The threads 112 of connector 100 have a smaller threadform angle 405 than the standard threadform for the ⅝" stud depicted, in this exemplary depiction approximately 59 ½°. By narrowing the threadform angle of connector 100 in accordance with the present invention, the threads 112 of connector 100 contact the stud 500 on two locations 800 at each stud thread crest 802 along an arc. In that way, greater conductivity and reduced electrical resistance can be achieved at lower set screw torque setting than a standard thread connector.

Figure 11:
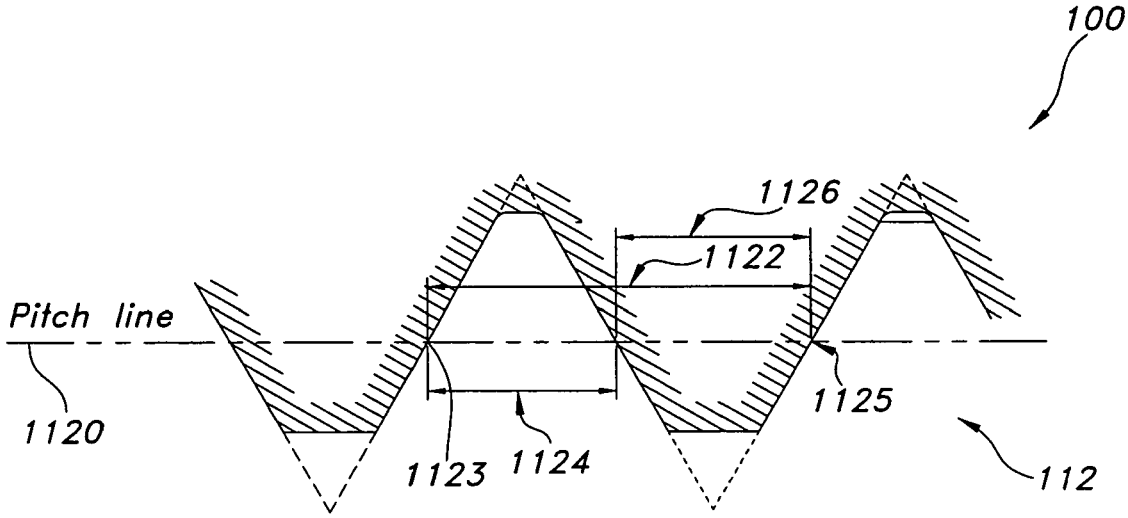
FIG. 11 is a cross-sectional drawing of an internal thread of an alternate embodiment according to the present invention.

Turning to FIG. 11 there is shown an alternate embodiment of the present invention. In the alternate embodiment depicted, the connector of the present invention utilizes an internal thread wherein the pitch dimension of each thread is larger than the thread valleys of standard internal thread. Turning now to FIG. 11 there is shown an enlarged view of connector 100 depicting thread 112. In the exemplary thread depicted, the pitch 1122 of thread 112 is measured along pitch line 1120. Pitch 1122 marks the distance from a point 1123 on a particular thread, to the corresponding point 1125 in the next thread, thereby measuring the length of one cycle of thread and valley along pitch line 1120. Furthermore, segments of the pitch line 1122, are delineated as "a" (valley) 1124, and "b" (crest) 1126 respectively, denoting the portion of the total distance of the pitch line for the valley "a" 1124 and the thread "b" 1126. The total pitch 1122 (p) distance is given as ($p=a+b$), where $a < p/2$ and $b > p/2$. Thus, obviously, $a \neq b$ and $a < b$. In this way, the thread pitch of connector 100 is varied such that the distance across each valley is shorter than that of a typical standard thread of the same nominal size. This will force engagement with the corresponding mating standard thread on stud 500.

Due to the variation in thread pitch, when a stud of the same nominal size and having a typical thread profile is threaded into connector 100, the threads 112 of connector 100 contact the threads 700 of stud 500 in such a was so as to provide two point contact between them along an arc for greater conductivity and reduced electrical resistance. The two point contact between the stud 500 and connector 100 is achieved because the valley distance 1124 of the threads of connector 100 is shorter that the mating crest distance of stud 500. By shortening the valley length 1124 of connector 100 in accordance with this embodiment of the present invention, the threads 112 of connector 100 contact stud 500 on opposite sides of its thread crest 802 along an arc. In that way greater conductivity and reduced electrical resistance can be achieved at lower set screw torque settings than a standard thread connector.

It will be appreciated that the present invention has been described herein with reference to certain preferred or exemplary embodiments. The preferred or exemplary embodiments described herein may be modified, changed, added to, or deviated from without departing from the intent, spirit and scope of the present invention.

What is claimed is:

1. An electrically conductive transformer stud connector comprising:

a connector body having an elongate passageway therethrough, said passageway having a threaded region defining first and second connector threads having different thread sizes for accommodating tranformer studs having two different stud threads and defining a stud threadform angle;

said first and second connector threads being overlaid tangentially along said passageway and defining thread roots and crests wherein said thread roots of said first and second connector threads are aligned and said thread crests of said first and second connector threads are non-aligned and wherein said connector threads further include thread flanks connecting said thread roots through said thread crests, said flanks diverge from said roots to form a connector threadform angle;

said connector threadform angle is different from said stud threadform angle so as to provide two lines of contact between said stud threads and said connector threads.

2. An electrically conductive transformer stud connector as set forth in claim 1 wherein said connector thread has a threadform angle less than the threadform angle of said stud thread.

3. An electrically conductive transformer stud connector as set forth in claim 1 wherein said connector thread forms an arc within said passageway and wherein there are at least two lines of contact between said stud thread and said connector thread when said stud is received into said connector.

4. An electrically conductive transformer stud connector as set forth in claim 1 further comprising at least one set screw port and at least one conductor port, said set screw port being in communication with said passageway.

5. A connector of claim 1 wherein one of said first and second connector threads is formed having said connector threadform angle of less than 59½°.

* * * * *

UNITED STATES PATENT AND TRADEMARK OFFICE

CERTIFICATE OF CORRECTION

PATENT NO. : 7,320,626 B2
APPLICATION NO. : 11/168016
DATED : January 22, 2008
INVENTOR(S) : Drane et al.

It is certified that error appears in the above-identified patent and that said Letters Patent is hereby corrected as shown below:

Column 3, line 67, the printed patent incorrectly reads "...body 106 and a an lower body…"; the patent should read --...body 106 and a lower body …--.

Column 6, line 57, the printed patent incorrectly reads "...in such a was so…"; the patent should read --...in such a way so…--.

Column 7, line 25, the printed patent incorrectly reads "...such a was so as to…"; the patent should read --...such a way so as to…--.

Column 8, line 4, the printed patent incorrectly reads "...such a was so as to…"; the patent should read --...such a way so as to…--.

Column 8, line 9, the printed patent incorrectly reads "...is shorter that the mating crest…"; the patent should read --...is shorter than the mating crest…--.

Signed and Sealed this

Twentieth Day of May, 2008

JON W. DUDAS
*Director of the United States Patent and Trademark Office*